US005501192A

United States Patent [19]

Cutler

[11] Patent Number: 5,501,192

[45] Date of Patent: Mar. 26, 1996

[54] AIR VALVE FOR THE INTAKE MANIFOLD OF AN INTERNAL COMBUSTION ENGINE

[75] Inventor: David K. Cutler, Plantation, Fla.

[73] Assignee: Cutler Induction Systems, Inc., North Miami Beach, Fla.

[21] Appl. No.: 319,060

[22] Filed: Oct. 6, 1994

[51] Int. Cl.[6] ..... F02M 23/02

[52] U.S. Cl. ..... 123/336; 123/590; 123/184.21

[58] Field of Search ..... 123/336, 337, 123/432, 184.21, 184.32, 184.36, 472, 593, 403, 590

[56] References Cited

U.S. PATENT DOCUMENTS

| | | | |
|---|---|---|---|
| D. 267,952 | 2/1983 | Martin . | |
| 1,916,500 | 7/1933 | Summers . | |
| 2,016,695 | 10/1935 | Timian . | |
| 2,075,790 | 4/1937 | Christensen | 123/336 |
| 2,124,403 | 7/1938 | McIntyre . | |
| 2,172,957 | 9/1939 | Firth . | |
| 2,730,339 | 1/1956 | Presnell . | |
| 2,827,030 | 3/1958 | Strumbos . | |
| 2,845,911 | 8/1958 | Gill . | |
| 2,869,527 | 1/1959 | Groves | 123/336 |
| 2,909,165 | 10/1959 | Dolza . | |
| 2,986,131 | 5/1961 | Larsen | 123/336 |
| 3,561,409 | 2/1971 | August | 123/336 |
| 3,730,160 | 5/1973 | Hughes | 123/184.32 |
| 3,742,923 | 7/1973 | Oblander . | |
| 3,943,904 | 3/1976 | Byrne | 123/336 |
| 4,254,747 | 3/1981 | Sumiyoshi . | |
| 4,344,396 | 8/1982 | Yamada | 123/337 |
| 4,452,218 | 6/1984 | Yokoyama et al. | 123/336 |
| 4,553,507 | 11/1985 | Shaffer . | |
| 4,660,530 | 4/1987 | Sugiyama . | |
| 4,674,465 | 6/1987 | Jimenez | 123/336 |
| 4,726,337 | 2/1988 | Yoshida . | |
| 4,766,853 | 8/1988 | Iwanami . | |
| 4,805,564 | 2/1989 | Hudson, Jr. . | |
| 4,809,647 | 3/1989 | Masumoto . | |
| 4,872,424 | 10/1989 | Carnes | 123/184.32 |
| 4,924,834 | 5/1990 | Bonfiglioli . | |
| 5,048,471 | 9/1991 | Takii . | |
| 5,105,774 | 4/1992 | Piccini . | |
| 5,279,270 | 1/1994 | Ichikawa et al. | 123/336 |

*Primary Examiner*—Thomas N. Moulis
*Attorney, Agent, or Firm*—Holland & Knight

[57] ABSTRACT

An air valve particularly intended for use with air intake manifolds of the type employed with fuel injected, internal combustion enginers, comprising a valve base adapted to be mounted to the plenum of the air intake manifold and a separate valve body sealingly engageable with a seat formed in the valve base. The valve body is formed with a number of inlet bores, each of which carry a rotatable throttle blade, and these inlet bores align with discharge bores in the valve base each having a radiused outlet edge or lip.

31 Claims, 2 Drawing Sheets

AIR VALVE FOR THE INTAKE MANIFOLD OF AN INTERNAL COMBUSTION ENGINE

FIELD OF THE INVENTION

This invention relates to air valves for the intake manifolds of internal combustion engines, and, more particularly, to a lightweight, two-piece air valve which is easy to service, adaptable for use with different fuel injection systems and which smoothly transmits a flow of air or an air-fuel mixture therethrough into the intake manifold.

BACKGROUND OF THE INVENTION

Intake manifolds for internal combustion engines generally comprise a manifold body formed with a plenum having an inlet and a hollow interior. A number of air passages or runners are formed in the manifold body each having an inlet at the plenum interior and an outlet connected to one of the cylinders of the engine. In many designs, a mixture of fuel and air, or air only, is directed into the interior of the plenum through a throttle valve mounted to the manifold body. The throttle valve controls the volume of air, or air-fuel mixture, entering the plenum for distribution to each of the runners.

Conventional throttle valves generally comprise a one-piece valve body having a base which is bolted to the intake manifold and a number of throughbores each mounting a throttle blade. The throttle blades are pivotally mounted within a respective throughbore by a shaft which is rotatable in response to pivoting of a throttle arm. The throttle blades are selectively movable between a fully open position and a fully closed position relative to their associated throughbores to control the flow of air and/or an air-fuel mixture therethrough and into the plenum interior of the manifold.

A number of problems inherent in the design of many throttle valves limit their effectiveness and versatility. One-piece throttle valves tend to be relatively heavy thus adding to the overall weight of the engine and reducing performance. Such valves are often difficult to service because access to the throttle blades, throttle arms, shafts and associated bearings is restricted in many of the current engine designs. If the throttle valve must be removed from the manifold to perform a service operation, a problem is presented of obtaining an effective seal with the manifold after the repairs are completed. This sealing problem can also occur if the throttle valve must be removed to accommodate different size air cleaners or supercharger bonnets, and/or different manifold bolt patterns or mounting flange configurations.

In addition to the foregoing limitations of conventional throttle valves, it has been recognized as discussed in U.S. patent application Ser. No. 08/319,294, filed Oct. 6, 1994 and entitled "Air Intake Manifold," that engine performance can suffer in the event turbulent flow is developed within the interior of the manifold. An inability to create a substantially laminar flow of air and/or an air-fuel mixture within the runners of the manifold can result in a loss of torque, decreased fuel efficiency and increased hydrocarbon emissions. Throttle valves of the type described above contribute to the creation of turbulence within the plenum interior of the manifold, and thus play a role in degrading engine performance and reducing torque output.

SUMMARY OF THE INVENTION

It is therefore among the objectives of this invention to provide a throttle or air valve for the intake manifold of an internal combustion engine which is easy to repair and/or replace, which is readily adaptable for use with different fuel supply systems, which reduces turbulence within the associated intake manifold and which is lightweight in construction.

These objectives are accomplished in a throttle or air valve, particularly intended for use with air intake manifolds of the type employed with fuel injected, internal combustion engines, comprising a valve base adapted to be mounted to the plenum of the air intake manifold and a separate valve body sealingly engageable with a seat formed in the valve base. The valve body is formed with a number of inlet bores, each of which carry a rotatable throttle blade, and these inlet bores align with discharge bores in the valve base each having an outlet edge or lip formed with a substantially 90° radius.

One aspect of this invention is predicated upon the concept of providing an air valve designed to transfer a flow of air into the plenum interior of an air intake manifold with minimum turbulence and a comparatively smooth, more laminar flow. It has been found that engine performance and torque output are adversely affected by disruption of the flow of air and/or an air-fuel mixture through the interior of the plenum and within the runners of intake manifolds. Such turbulence reduces the efficiency with which air and/or air-fuel mixture is transmitted into the cylinders of the engine to which the manifold is mounted, thus reducing engine performance and lowering torque output for a given speed of operation of the engine. This problem is reduced with the air valve of this invention by the construction of both the valve body and valve base. Preferably, the inlet bores of the valve body each form an inner wall having a radiused lip at the inlet end, a substantially vertical portion at the outlet end and an intermediate portion which angles radially inwardly from the radiused lip to the vertical portion at the outlet end. Air, or an air-fuel mixture, entering the valve body is smoothly transferred within each inlet bore thereof into an aligning discharge bore in the valve base. Each discharge bore, in turn, is formed with a substantially 90° radius at the outlet end thereof which substantially eliminates vortices in the air flow after it exits the air valve, and assists in smoothly fanning out the air flow into the larger area of the interior of the plenum of the manifold. As a result, the stream of air entering the plenum interior from the air valve is more smoothly directed into each of the runners of the manifold in a more laminar flow with less turbulence. In turn, a more laminar air flow is achieved within each of the runners which aids in maintaining velocity of the air flow therethrough at low engine speeds, and also permits more air flow to pass through the runners at high engine speeds.

In addition to the improved air flow characteristics provided by the air valve of this invention, a number of advantages are obtained by its two-piece construction. As noted above, the air valve is formed with a valve base mounted to the plenum of an air intake manifold and a valve body mounted within a seat formed in the valve base. With this construction, the valve body may be readily removed from the valve base without disturbing its position on the manifold allowing repairs to be made on the throttle blades, shafts, bearings, throttle arms and other parts carried by the valve body. Additionally, one valve body may be exchanged for a valve body of another type or configuration to accommodate different sized air cleaners, supercharger bonnets or other engine alterations. Regardless, the valve base remains in place on the manifold thus maintaining the seal therebetween. Further, because the valve body is separate from the valve base, machining operations can be performed in the fabrication of the valve body which reduce its overall size and weight compared to conventional, one-piece throttle valves.

Additionally, there may be instances in which it is desired to exchange one valve base with another depending upon the configuration of the intake manifold on a particular engine. This can be done with the subject invention, while employing the same valve body, thus reducing the overall inventory of parts needed to accommodate different engine designs which reduces costs.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
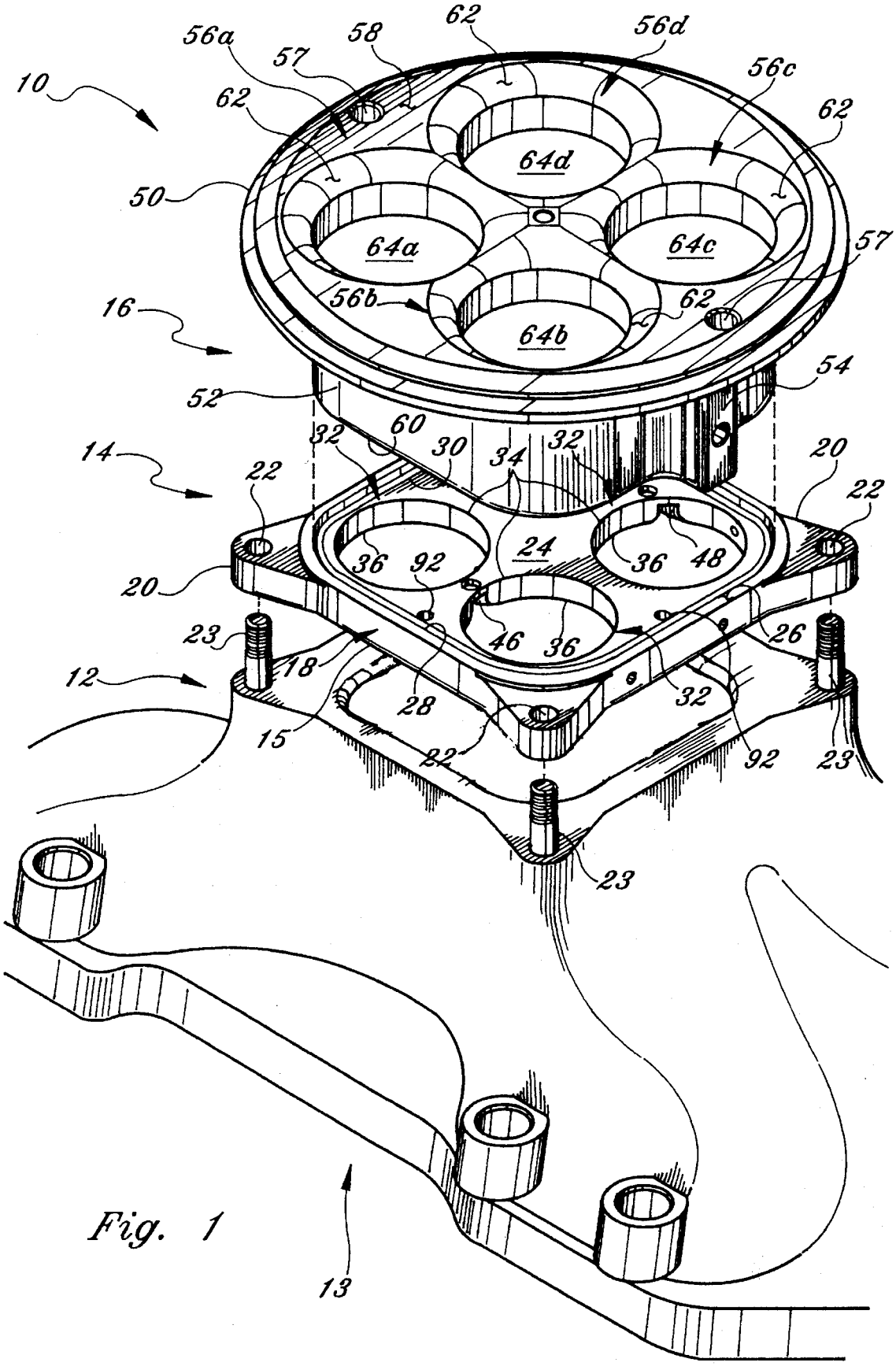
FIG. 1 is a partially disassembled perspective view of the two-piece air valve of this invention and a portion of an air intake manifold to which the air valve is mounted.

Referring now to the Figs., a throttle or air valve 10 is illustrated which is designed for mounting to the inlet end 11 of the plenum 12 of an air intake manifold 13, preferably of the type disclosed in U.S. patent application Ser. No. 08/319,294 entitled "Air Intake Manifold" filed Oct. 6, 1994, which is owned by the assignee of this invention, and the disclosure of which is incorporated by reference in its entirety herein. The air valve 10 is a two-piece construction comprising a valve base 14 and a separate valve body 16.

In the presently preferred embodiment, the valve base 14 includes a peripheral edge 18 having a number of mounting tabs 20 each formed with a throughbore 22. The throughbores 22 of mounting tabs 20 receive studs 23 carried by the plenum 12 so that the air valve 10 can be secured to the plenum 12 of the air intake manifold 13 with nuts (not shown). A gasket (not shown) is preferably interposed between the bottom surface 15 of the valve base 14 and plenum 12 to create a seal therebetween.

The center portion of valve base 14 is formed with a recessed plate 24 which is connected to the peripheral edge 18 in position below its top surface 26 so that a valve seat 28 is formed at the intersection between the recessed plate 24 and peripheral edge 18. As described in more detail below, the valve seat 28 carries an o-ring 30 which creates a seal between the valve body 16 and valve base 14.

Figure 2:
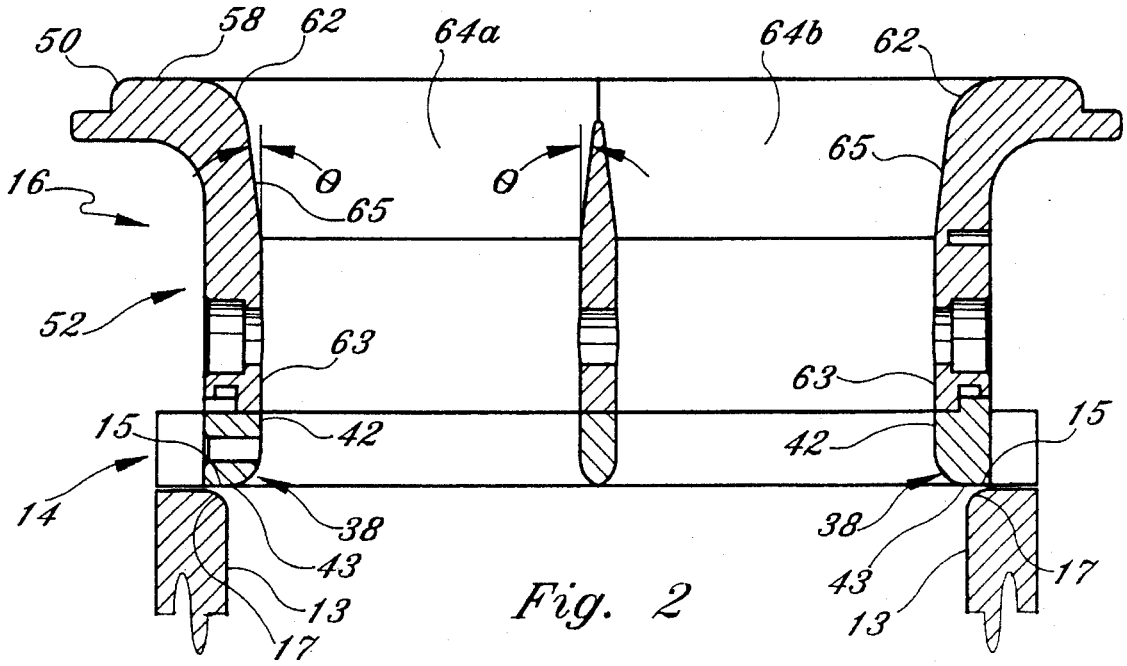
FIG. 2 is a partial cross-sectional view illustrating the air valve herein.

In the embodiment of air valve 10 depicted in the Figs., four discharge bores 32 are formed in the recessed plate 24, only three of which are depicted in FIG. 1 each having an inlet end 34 and an outlet end 36. As best shown in FIG. 2, the outlet end 36 of each discharge bore 32 is formed with a radius 38, preferably of about 0.250 inches. This radius 38 extends from the bottom surface 15 of valve base 14 along the inner wall 42 of each of the discharge bores 32 in a direction generally toward the top surface 26 of the peripheral edge 18. It has been found that the formation of a smoothly curved radius 38 on outlet end 36 of discharge bores 32 reduces turbulence in the flow of air into the interior of plenum 12. It is believed that the radius 38 on outlet end 36 of discharge bores 32 reduces vortices in the air flow passing into the plenum 12, and enables the air flow to fan outwardly within the plenum interior thus further reducing turbulence. As discussed in patent application Ser. No. 08/319,294, mentioned above, the reduction of turbulence within the plenum interior increases engine performance and torque output, increases fuel efficiency and decreases emissions from the combustion process.

With reference to FIG. 2, the size of the bottom surface 15 of valve base 14 and the inlet end 11 of plenum 12 are specifically designed to compliment one another and avoid any blockage or interference with the discharge bores 32. Preferably, the wall 13 at the inlet end 11 of plenum 12 is located at, or radially outwardly from, the point of intersection 43 between the radius 38 at the outlet end 36 of each discharge bore 32 and the bottom surface 15 of valve base 14. The wall 13 is preferably formed with a radius 17 at the inlet end 11 of about 90°. It has been found that the air flow from the discharge bores 32 fans outwardly and exhibits less turbulence, as noted above, with the wall 13 of plenum 12 positioned radially outwardly from such point of intersection 43 thus avoiding any blockage or interference with the air flow passing between the air valve 10 and plenum 12. The recessed plate 24 of valve base 14 is also formed with a cross passage 46 extending between two of the discharge bores 32, and a cross passage 48 extending between the other two discharge bores 32. These cross passages 46, 48 tend to equalize the air flow within each of the discharge bores 32 so that a substantially uniform flow of air from the valve base 14 is introduced throughout the entire plenum interior.

With reference to FIGS. 1 and 2, the valve body 16 of air valve 10 comprises an upper ring 50 and an inwardly tapered, center portion 52 having opposed ribs 54, one of which is shown in FIG. 1. The valve body 16 is formed with four inlet bores **56*a–d* which extend from the top surface 58 of the upper ring 50 to the bottom surface 60 of the center portion 52, and a pair of air bleed holes 57. Each of the inlet bores 56*a–d* form an inner wall having a radiused inlet portion 62, a substantially vertically extending outlet portion 63 which terminates at bottom surface 60, and, a tapered intermediate portion 65 located between the radiused inlet portion 62 and outlet portion 63. In the presently preferred embodiment, the inlet portion 62 is formed with a radius of about 0.375 inches extending in a direction toward the outlet portion 63. The tapered intermediate portion 65 is angled radially inwardly from the inlet portion 62 to the outlet portion 63 at an angle θ with respect to vertical preferably in the range of about 5–25° and most preferably about 7°. The tapered intermediate portion 65 terminates at a vertical distance of about 1.125 inches from the top surface 58 of upper ring 50, where the outlet portion 63** begins.

Figure 3:
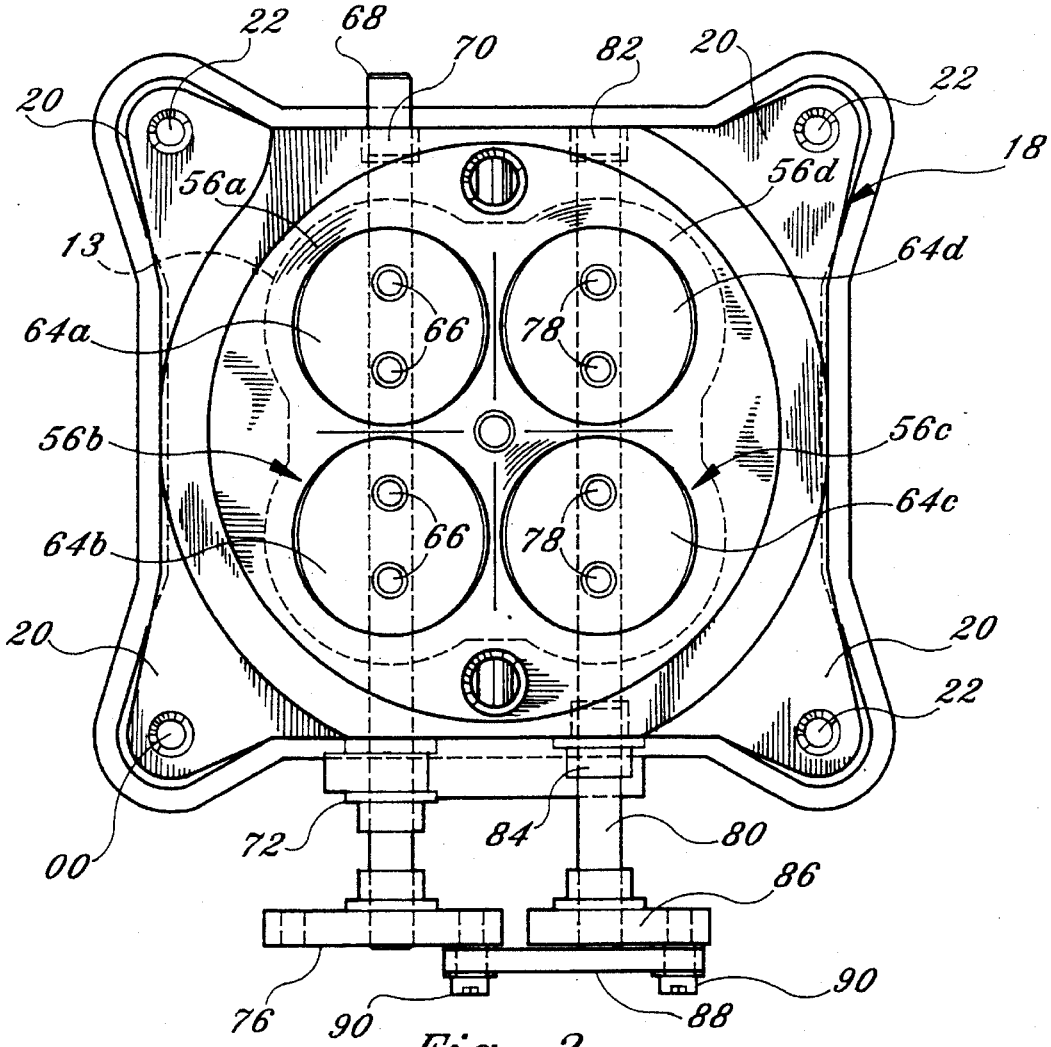
FIG. 3 is a plan view of the air valve of this invention.

As best shown in FIG. 3, each of the inlet bores **56*a–d* mounts a pivotal throttle blade 64*a–d*, respectively. Preferably, the radius of each inlet edge is approximately 90°. The throttle blades 64*a* and 64*b* are mounted by rivets 66 to a shaft 68 which is rotatably carried at opposite ends by bearings 70 and 72 mounted to the upper ring 50 of valve body 16. One end of the shaft 68 is retained within the bearing 70 by a pin (not shown), and the opposite end thereof is connected to a first throttle arm 76. Similarly, the throttle blades 64*c* and 64*d* are mounted by rivets 78 to a second shaft 80 which is rotatable within bearings 82, 84 carried by upper ring 50. One end of the second shaft 80 is mounted to a second throttle arm 86, which, in turn, is pivotally connected by a connector arm 88 to the first throttle arm 76. Preferably, screws 90 or other fasteners are employed to attach the connector arm 88 to the first and second throttle arms 76, 86. Conventionally, the throttle blades 64***a–d* are pivotal between a fully closed position depicted in FIG. 1 and a fully open position (not shown) by rotation of shafts 68, 80 in response to pivoting of the throttle arms 76, 86.

As best shown in FIGS. 1 and 2, the valve body 16 is mounted to the valve base 14 by inserting the center portion 52 of valve body 16 atop the recessed plate 24 and against the valve seat 28 within valve base 14. In the assembled position, the bottom surface 60 of center portion 52 makes metal-to-metal contact with the recessed plate 24, and the inlet bores 56*a–d* of valve body 16 align with the discharge bores 32*a–d*, respectively, of valve base 14. The base of center portion 52 of valve body 16 is dimensioned such that its circumferential edge snugly fits within the valve seat 28, with the o-ring seal 30 providing a seal therebetween. In order to interconnect the valve base 14 and valve body 16, screws (not shown) are inserted through each of four throughbores 92 in the recessed plate 24 of valve base 14, two of which are shown in FIG. 1, and into threaded bores (not shown) formed in the base of valve body 16.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, while the valve 10 of this invention has been described primarily as an "air valve" particularly intended for use with an air intake manifold, it is contemplated that such valve could also be utilized to introduce a mixture of fuel and air into the plenum of a manifold connected to a fuel injection system.

Therefore, it is intended that the invention not be limited to the particular embodiment disclosed as the best mode contemplated for carrying out this invention, but that the invention will include all embodiments falling within the scope of the appended claims.

I claim:

1. An air valve for the intake manifold of an internal combustion engine, comprising:

a valve base adapted to be mounted to an air intake manifold, said valve base being formed with at least one discharge bore, a peripheral edge and a recessed plate which intersects said peripheral edge, said recessed plate and said peripheral edge forming a seat at the intersection thereof;

a valve body sealingly engageable with said seat in said valve base, said valve body being formed with at least one inlet bore alignable with said at least one discharge bore;

a throttle blade rotatably mounted within said at least one inlet bore, said throttle blade being pivotal between an open position in which a flow of air is permitted to pass through said inlet bore to said discharge bore in said valve base, and a closed position in which the air flow through said at least one inlet bore is substantially blocked.

2. The air valve of claim 1 in which an o-ring seal is carried by said seat to create a seal between said valve body and said valve base.

3. The air valve of claim 1 in which a number of discharge bores are formed in said recessed plate of said valve base, each of said discharge bores being connected to at least one other discharge bore by a cross passage.

4. The air valve of claim 1 in which said at least one discharge bore has an inlet end and an outlet end, said outlet end of said discharge bore being formed with a radius.

5. The air valve of claim 4 in which said radius of said outlet end of said at least one discharge bore is about 0.250 inches.

6. The air valve of claim 1 in which said at least one inlet bore in said valve body is formed with an inlet end and an outlet end, said inlet end of said at least one inlet bore being formed with a radius.

7. The air valve of claim 6 in which said radius of said inlet end of said at least one inlet bore is about 0.375 inches.

8. The air valve of claim 1 in which said at least one inlet bore in said valve body defines an inner wall, said inner wall having a radiused inlet portion, a substantially vertically oriented outlet portion and a tapered intermediate portion extending between said inlet and outlet portions.

9. The air valve of claim 8 in which said tapered intermediate portion extends radially outwardly in a direction from said inlet portion toward said outlet portion at an angle with respect to vertical in the range of about 5°–25°.

10. The air valve of claim 9 in which said angle is about 7°.

11. An air valve for the intake manifold of an internal combustion engine, comprising:

a valve base having opposed, first and second faces, said second face being adapted to mount onto the intake manifold of an internal combustion engine, said valve base being formed with a seat and at least one discharge bore extending therethrough which includes an inlet end at said first face and an outlet end at said second face, said outlet end of said discharge bore being formed with a radius extending from said second face in a direction toward said first face;

a valve body sealingly engageable with said seat in said valve base, said valve body being formed with at least one inlet bore alignable with said at least one discharge bore;

a throttle blade rotatably mounted within said at least one inlet bore, said throttle blade being pivotal between an open position in which a flow of air is permitted to pass through said inlet bore to said discharge bore in said valve base, and a closed position in which the air flow through said at least one inlet bore is substantially blocked.

12. The air valve of claim 11 in which said valve base is formed with a peripheral edge and a recessed plate which intersects said peripheral edge, said recessed plate and said peripheral edge forming said seat at the intersection thereof.

13. The air valve of claim 12 in which an o-ring seal is carried by said seat to create a seal between said valve body and said valve base.

14. The air valve of claim 12 in which a number of discharge bores are formed in said recessed plate of said valve base, each of said discharge bores being connected to at least one other discharge bore by a cross passage.

15. The air valve of claim 11 in which said radius of said outlet end of said at least one discharge bore is about 0.250 inches.

16. The air valve of claim 11 in which said at least one inlet bore in said valve body is formed with an inlet end and an outlet end, said inlet end of said at least one inlet bore being formed with a radius.

17. The air valve of claim 16 in which said radius of said inlet end of said at least one inlet bore is about 0.375 inches.

18. The air valve of claim 11 in which said at least one inlet bore in said valve body defines an inner wall, said inner wall having a radiused inlet portion, a substantially vertically oriented outlet portion and a tapered intermediate portion extending between said inlet and outlet portions.

19. The air valve of claim 18 in which said tapered intermediate portion extends radially outwardly in a direction from said inlet portion toward said outlet portion at an angle with respect to vertical in the range of about 5°–25°.

20. The air valve of claim 19 in which said angle is about 7°.

21. An apparatus including the combination of an air valve and an intake manifold for an internal combusion engine, comprising:

a manifold body including a plenum having an inlet defined by a plenum wall;

a valve base formed with a seat and at least one discharge bore having an inlet end and an outlet end, said outlet end of said at least one discharge bore being formed with a radius which intersects a mounting surface of said valve base, said valve base being mounted to said plenum of said manifold body so that said plenum wall is located at or radially outwardly from said point of intersection between said radius and said mounting surface of said valve base;

a valve body sealingly engageable with said seat in said valve base, said valve body being formed with at least one inlet bore alignable with said at least one discharge bore;

a throttle blade rotatably mounted within said at least one inlet bore, said throttle blade being pivotal between an open position in which a flow of air is permitted to pass through said inlet bore to said discharge bore in said valve base, and a closed position in which the air flow through said at least one inlet bore is substantially blocked.

22. The apparatus of claim 21 in which said plenum wall is formed with a radius at said inlet of said plenum.

23. The apparatus of claim 21 in which said valve base is formed with a peripheral edge and a recessed plate which intersects said peripheral edge, said recessed plate and said peripheral edge forming said seat at the intersection thereof.

24. The apparatus of claim 23 in which an o-ring seal is carried by said seat to create a seal between said valve body and said valve base.

25. The apparatus of claim 23 in which a number of discharge bores are formed in said recessed plate of said valve base, each of said discharge bores being connected to at least one other discharge bore by a cross passage.

26. The apparatus of claim 21 in which said radius of said outlet end of said at least one discharge bore is about 0.250 inches.

27. The apparatus of claim 21 in which said at least one inlet bore in said valve body is formed with an inlet end and an outlet end, said inlet end of said at least one inlet bore being formed with a radius.

28. The apparatus of claim 27 in which said radius of said inlet end of said at least one inlet bore is about 0.375 inches.

29. The apparatus of claim 21 in which said at least one inlet bore in said valve body defines an inner wall, said inner wall having a radiused inlet portion, a substantially vertically oriented outlet portion and a tapered intermediate portion extending between said inlet and outlet portions.

30. The apparatus of claim 29 in which said tapered intermediate portion extends radially outwardly in a direction from said inlet portion toward said outlet portion at an angle with respect to vertical in the range of about 5°–25°.

31. The apparatus of claim 30 in which said angle is about 7°.

* * * * *